US010014096B2

(12) United States Patent
Zheng

(10) Patent No.: US 10,014,096 B2
(45) Date of Patent: Jul. 3, 2018

(54) HORIZONTAL AUTOMATIC TENSION TAPING MACHINE

(71) Applicant: DONGGUAN QINGFENG ELECTRIC MACHINERY CO., LTD, Guangdong (CN)

(72) Inventor: Qingjun Zheng, Guangdong (CN)

( * ) Notice: Subject to any disclaimer, the term of this patent is extended or adjusted under 35 U.S.C. 154(b) by 136 days.

(21) Appl. No.: 14/910,266

(22) PCT Filed: Sep. 23, 2014

(86) PCT No.: PCT/CN2014/000860
§ 371 (c)(1),
(2) Date: Feb. 5, 2016

(87) PCT Pub. No.: WO2015/051593
PCT Pub. Date: Apr. 16, 2015

(65) Prior Publication Data

US 2016/0343477 A1 Nov. 24, 2016

(30) Foreign Application Priority Data

Oct. 9, 2013 (CN) ..... 2013 1 0464766

(51) Int. Cl.
*H01B 13/26* (2006.01)
*B65H 59/10* (2006.01)

(52) U.S. Cl.
CPC ..... *H01B 13/26* (2013.01); *B65H 59/10* (2013.01)

(58) Field of Classification Search
CPC ..... H01B 13/26; B65H 9/10
See application file for complete search history.

(56) References Cited

U.S. PATENT DOCUMENTS 4,134,953 A * 1/1979 Dembiak ..... H01B 7/1875 156/54
4,319,940 A * 3/1982 Arroyo ..... H01B 7/295 156/185
2006/0242824 A1* 11/2006 Varkey ..... H01B 13/26 29/825

FOREIGN PATENT DOCUMENTS

CN 102280215 A * 12/2011

* cited by examiner

*Primary Examiner* — Shaun R Hurley
(74) *Attorney, Agent, or Firm* — Prakash Nama; Global IP Services, PLLC

(57) ABSTRACT

A horizontal automatic tension taping machine comprises a swing rod buffering tension pay-off rack (1), and the swing rod buffering tension pay-off rack (1), a tension balancing wheel (2), a taping machine (3), a ground wire pay-off machine (4), a next taping machine (5), an oven (6), a next ground wire pay-off machine (7), a next taping machine (8), a next oven (9), a crawler take-up machine (10) and an axial row type wire-winding machine (11) are orderly butted. All the parts (1-11) are connected with, a control cabinet (12). The tension balancing wheel (2) is added to, the swing rod buffering tension pay-off rack, so that pay-off tension consistency of a core wire and a ground wire is ensured; the taping machine is provided with a positioning threading pipe (21), a tapping pipe (28) and controllable tapping tension, and it is guaranteed that the positions of the core wire and the ground wire are not changed while the high-speed wrapping is performed, so that a wrapping tape is stable in pitch and consistent in elasticity.

4 Claims, 2 Drawing Sheets

HORIZONTAL AUTOMATIC TENSION TAPING MACHINE

BACKGROUND OF THE INVENTION

The present invention relates to the field of cable manufacturing equipment technology, specifically a horizontal automatic tension taping machine.

Currently the high-frequency data line is manufactured in the industry generally with double wired conductors in parallel side by side in addition to 1-4 ground wires covered by an aluminum foil or a copper foil for shielding. It should be guaranteed that there is no position change or overturning of the parallel core wire and the ground wire; it should be also guaranteed that the wrapping tape is stable and has consistent elasticity, so as to make the high-frequency data line quick in transmission and stable in performance. With a threading positioning die used in all the current industry equipment, although the stable position of the parallel core wire and the ground wire can be guaranteed, since the rotational speed of the wrapping tape is not high, when the wrapping tape is rotated at a high speed, the wrapping tape will flaunt in the presence of wind resistance, such that the wrapping tape is not stable in pitch and not consistent in elasticity.

Besides, with the swing rod buffering used as the tension (the counter pull) for paying off, it is difficult to ensure comp fete tension consistency of two core wires, which results in unstability of the wrapping tape in pitch. The high-frequency data line such manufactured may have unstable performance, which is inconvenient for users in normal use and even results in loss.

BRIEF SUMMARY OF THE INVENTION

A technical problem to be solved by the present invention is to provide a horizontal automatic tension taping machine that can guarantee pay-off tension consistency of the core wire and the ground wire, pitch stability of the wrapping tape, and stable performance.

In order to solve the above technical problem, the present invention adopts the following technical solution: A horizontal automatic tension taping machine is provided, characterized in that: it comprises a swing rod buffering tension pay-off rack, and the swing rod buffering tension pay-off rack, a tension balancing wheel, a taping machine, a ground wire pay-off machine, a next taping machine, an oven, a next ground wire pay-off machine, a next taping machine, a next oven, a crawler take-up machine and an axial row type wire-winding machine are orderly butted; all the parts are connected with a control cabinet; the tension balancing wheel includes a support rod, on which is mounted a tension wheel that is connected with a magnetic powder tension machine; on the support rod is also mounted a tension detection wheel, which is connected with a pressure sensor; at the top of the support rod is mounted an automatic tension controller, to which are connected the magnetic powder tension machine and the pressure sensor; the taping machine comprises a positioning threading pipe, a seated bearing, a rotary shaft, a slip ring carbon brush, a magnetic hysteresis tension machine, a rotary cradle and a taping pipe, wherein the rotary shaft is mounted in the two seated bearings, the positioning threading pipe butts against the rotary shaft and goes through the rotary shaft, the slip ring carbon brush, the magnetic hysteresis tension machine and the rotary cradle are mounted on the rotary shaft, the rotary cradle is connected with the magnetic hysteresis tension machine, and the taping pipe is mounted at the front end of the rotary shaft and butts against the positioning threading pipe.

Furthermore, the tension wheel is connected with the magnetic powder tension machine through a coupling; and the tension detection wheel and the pressure sensor are located above the tension wheel.

Furthermore at the front end of the rotary cradle are mounted a plurality angle guide rollers for supporting a wrapping tape to pass.

Furthermore, the core wire and the ground wire, after going out of the swing rod buffering tension pay-off rack, are wound onto a rubber covered tension wheel and, after passing the tension detection wheel, go into the positioning threading pipe on the taping machine; when there is pay-off tension fluctuation due to influence of the wrapping tape of the taping machine, the pressure sensor feedbacks to the automatic tension controller, which changes output voltage to regulate and control the magnetic powder friction of the magnetic powder tension machine, thus changing the pay-off tension of the tension wheel and ensuring tension stability and consistency of the core wire and the ground wire entering the taping machine; with the core wire and the ground wire entering the taping pipe via the positioning threading pipe, the wrapping tape is mounted on the shaft of the magnetic hysteresis tension machine, goes by the angle guide roller on the rotary cradle into the taping pipe and is wound onto the core wire and the ground wire by rotation of the rotary shaft, with the positioning threading pipe ensuring no position change or overturning of the core wire and the ground wire; the DC power controlled and outputted by a programmable controller regulates the tension of the magnetic hysteresis tension machine, thus controlling the tension of the wrapping tape.

The present invention ensures pay-off tension consistency of the core wire and the ground wire by adding a tension balancing wheel to the paying off; the wrapping machine, provided with a special positioning threading pipe, taping pipe and controllable taping tension, guarantees no position change of the core wire and the ground wire while the high-speed wrapping is performed, and prevents the wrapping tape from flaunting during the high-speed wrapping due to wind resistance, so that the wrapping tape is stable in pitch and consistent in elasticity, thus making the cable performance more stable.

In the figures: 1. A swing rod buttering tension pay-oft rack; 2. a tension balancing wheel; 3. a taping machine; 4. a ground wire pay-off machine; 5. a taping machine; 8. an oven; 7, a ground wire pay-off machine; 8. a taping machine; 9. an oven; 10. a crawler take-up machine; 11. an axial row type wire-winding machine 12. a control cabinet; 13. a support rod; 14. an automatic tension controller; 15. a tension wheel; 16. a coup ling; 17, a magnetic powder tension machine; 18, a tension detection wheel; 19. a pressure sensor; 20. a wrapping tape; 21. a positioning threading pipe; 22. a seated bearing; 23. a rotary shaft; 24, a seated bearing; 25. a slip ring carbon brush; 26. a magnetic hysteresis tension machine; 27. a rotary cradle; 28. a taping pipe; and 29. an angle guide roller.

DETAILED DESCRIPTION OF THE INVENTION

Figure 1:
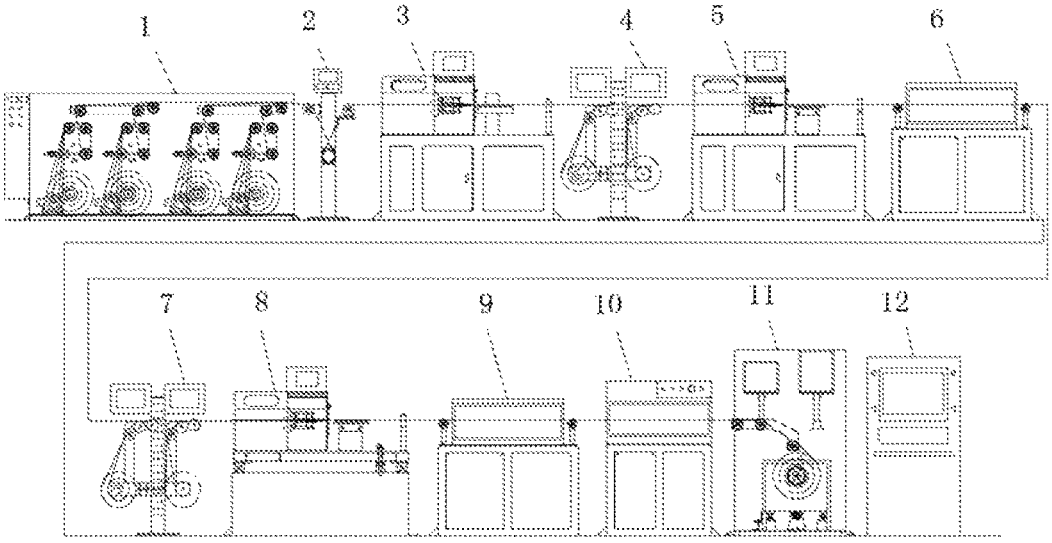
FIG. 1 shows the unitary planar structure of the present invention.
Figure 2:
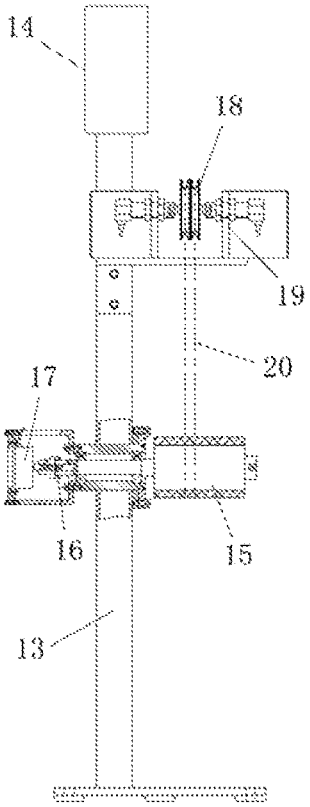
FIG. 2 shows the structure of the tension balancing wheel of the present invention.
Figure 3:
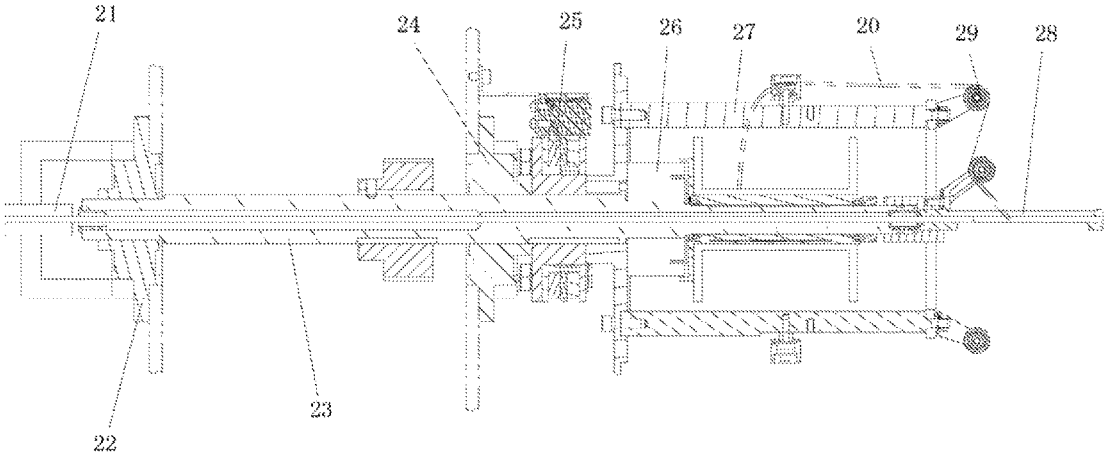
FIG. 3 shows the cross-sectional structure of the taping machine of the present invention.

As shown in FIGS. 1, 2 and 3, in this example is provided a horizontal automatic tension taping machine, which comprises a swing rod buffering tension pay-off rack 1, and the swing rod buffering tension pay-off rack 1, a tension balancing wheel 2, a taping machine 3, a ground wire pay-off machine 4, a next taping machine 5, an oven 6, a next ground wire pay-off machine 7, a next taping machine 8, a next oven 9, a crawler take-up machine 10 and an axial row type wire-winding machine 11 are orderly butted; all the parts 1-11 are connected with a control cabinet 12; the tension balancing wheel 2 includes a support rod 13, on which is mounted a tension wheel 15 that is connected with a magnetic powder tension machine 17; on the support rod 13 is also mounted a tension detection wheel 18, which is connected with a pressure sensor 19; at the top of the support rod 13 is mounted an automatic tension controller 14, to which are connected the magnetic powder tension machine 17 and the pressure sensor 19; the taping machines 3, 5 and 8, having the same structure, comprise a positioning threading pipe 21, seated bearings 22 and 24, a rotary shaft 23, a slip ring carbon brush 25, a magnetic hysteresis tension machine 26, a rotary cradle 27 and a taping pipe 28, wherein the rotary shaft 23 is mounted in the two seated bearings 22 and 24, the positioning threading pipe 21 butts against the rotary shaft 23 and goes through the rotary shaft 23, the slip ring carbon brush 25, the magnetic hysteresis tension machine 26 and the rotary cradle 27 are mounted on the rotary shaft 23, the rotary cradle 2 connected with the magnetic hysteresis tension machine 26, and the taping pipe 28 is mounted at the front end of the rotary shaft 23 and butts against the positioning threading pipe 21.

The tension wheel 15 is connected with the magnetic powder tension machine 17 through a coupling 16; and the tension detection wheel 18 and the pressure sensor 19 are located above the tension wheel 15.

At the front end of the rotary cradle 27 are mounted a plurality of angle guide rollers 29 for supporting a wrapping tape to pass.

The core wire and the ground wire, after going out of the swing rod buffering tension pay-off rack 1, are wound onto a rubber covered tension wheel 15 and, after passing the tension detection wheel 18, go into the positioning threading pipe 21 on the taping machine 3; when there is pay-off tension fluctuation due to influence of the wrapping tape 20 of the taping machine, the pressure sensor 19 feedbacks to the automatic tension controller 14, which changes output voltage to regulate and control the magnetic powder friction of the magnetic powder tension machine 17, thus changing the pay-off tension of the tension wheel 15 and ensuring tension stability and consistency of the core wire and the ground wire entering the taping machine; with the core wire and the ground wire entering the taping pipe 28 via the positioning threading pipe, the wrapping tape 20 is mounted on the shaft of the magnetic hysteresis tension machine 26, goes by the angle guide roller 29 on the rotary cradle 27 into the taping pipe 28, and is wound onto the core wire and the ground wire by rotation of the rotary shaft 23, with the positioning threading pipe 21 ensuring no position change or overturning of the core wire and the ground wire; the DC power controlled and outputted by a programmable controller regulates the tension of the magnetic hysteresis tension machine 26 thus controlling the tension of the wrapping tape.

The contents above, as detailed description of the present invention, are only the preferred example of the present invention, and cannot limit the scope of application of the present invention; and all the equivalent alteration and modification made within the scope of this application should all fail within the scope of the present invention.

What is claimed is:

1. A horizontal automatic tension taping machine, characterized in that: it comprises a swing rod buffering tension pay-off rack, a tension balancing wheel, a taping machine, a ground wire pay-off machine, a second taping machine, an oven, a next ground wire pay-off machine, a third taping machine, a next oven, a crawler take-up machine and an axial row type wire-winding machine are orderly butted; the swing rod buffering tension pay-off rack, the tension balancing wheel, the taping machine, the around wire pay-off machine, the second taping machine, the oven, the next around wire pay-off machine, the third taping machine, the next oven, the crawler take-up machine and the axial row type wire-winding machine are connected with a control cabinet; the tension balancing wheel includes a support rod, on which is mounted a tension wheel that is connected with a magnetic powder tension machine; on the support rod is also mounted a tension detection wheel, which is connected with a pressure sensor; at the top of the support rod is mounted an automatic tension controller, to which are connected the magnetic powder tension machine and the pressure sensor; the horizontal automatic tension taping machine comprises a positioning threading pipe, a seated bearing, a rotary shaft, a slip ring carbon brush, a magnetic hysteresis tension machine, a rotary cradle and a taping pipe, wherein the rotary shaft is mounted in the two seated bearings, the positioning threading pipe butts against the rotary shaft and goes through the rotary shaft, the slip ring carbon brush, the magnetic hysteresis tension machine and the rotary cradle are mounted on the rotary shaft, the rotary cradle is connected with the magnetic hysteresis tension machine, and the taping pipe is mounted at the front end of the rotary shaft and butts against the positioning threading pipe.

2. The horizontal automatic tension taping machine according to claim 1, characterized in that: the tension wheel is connected with the magnetic powder tension machine through a coupling; and the tension detection wheel and the pressure sensor are located above the tension wheel.

3. The horizontal automatic tension taping machine according to claim 1, characterized in that: at the front end of the rotary cradle are mounted a plurality of angle guide rollers for supporting a wrapping tape to pass.

4. The horizontal automatic tension taping machine according to claim 3, characterized in that: a core wire and a ground wire, after going out of the swing rod buffering tension pay-off rack, are wound onto a rubber covered tension wheel and, after passing the tension detection wheel, go into the positioning threading pipe on the horizontal automatic tension taping machine; when there is pay-off tension fluctuation due to influence of the wrapping tape of the taping machine, the pressure sensor feedbacks to the automatic tension controller, which changes output voltage to regulate and control the magnetic powder friction of the magnetic powder tension machine, thus changing the pay-off tension of the tension wheel and ensuring tension stability and consistency of the core wire and the ground wire entering the taping machine; with the core wire and the ground wire entering the taping pipe via the positioning threading pipe, the wrapping tape is mounted on the shaft of the magnetic hysteresis tension machine, goes by the angle guide roller on the rotary cradle into the taping pipe, and is wound onto the core wire and the ground wire by rotation of the rotary shaft, with the positioning threading pipe ensuring no position change or overturning of the core wire and the ground wire; the DC power controlled and outputted by a programmable controller regulates the tension of the magnetic hysteresis tension machine, thus controlling the tension of the wrapping tape.

* * * * *